United States Patent [19]

Green et al.

[11] 4,325,803

[45] Apr. 20, 1982

[54] PROCESS FOR HYDROGENATION/EXTRACTION OF ORGANICS CONTAINED IN ROCK

[75] Inventors: Marvin I. Green, Oradell; Abraham P. Gelbein, Morristown, both of N.J.

[73] Assignee: Chem Systems Inc., New York, N.Y.

[21] Appl. No.: 176,008

[22] Filed: Aug. 7, 1980

[51] Int. Cl.[3] ..... C10G 1/04

[52] U.S. Cl. ..... 208/11 LE

[58] Field of Search ..... 208/11 R, 11 LE, 56

[56] References Cited

U.S. PATENT DOCUMENTS

| | | | |
|---|---|---|---|
| 2,487,788 | 11/1949 | Buchan | 208/11 LE |
| 2,601,257 | 6/1952 | Buchan | 208/11 LE |
| 2,639,982 | 5/1953 | Kalbach | 208/11 R |
| 2,772,209 | 11/1956 | Stewart | 208/11 LE |
| 2,847,306 | 8/1958 | Stewart | 208/11 LE |
| 4,238,315 | 12/1980 | Patzer | 208/11 LE |

*Primary Examiner*—T. M. Tufariello

*Attorney, Agent, or Firm*—Bert J. Lewen; James J. Long

[57] ABSTRACT

A method for the separation and recovery of organic material from rock, including the steps of forming a slurry containing the rock bearing the organic material and hydrogenating said material via a hydrogen transfer agent which is a liquid at standard conditions.

29 Claims, 1 Drawing Figure

PROCESS FOR HYDROGENATION/EXTRACTION OF ORGANICS CONTAINED IN ROCK

Figure 1:
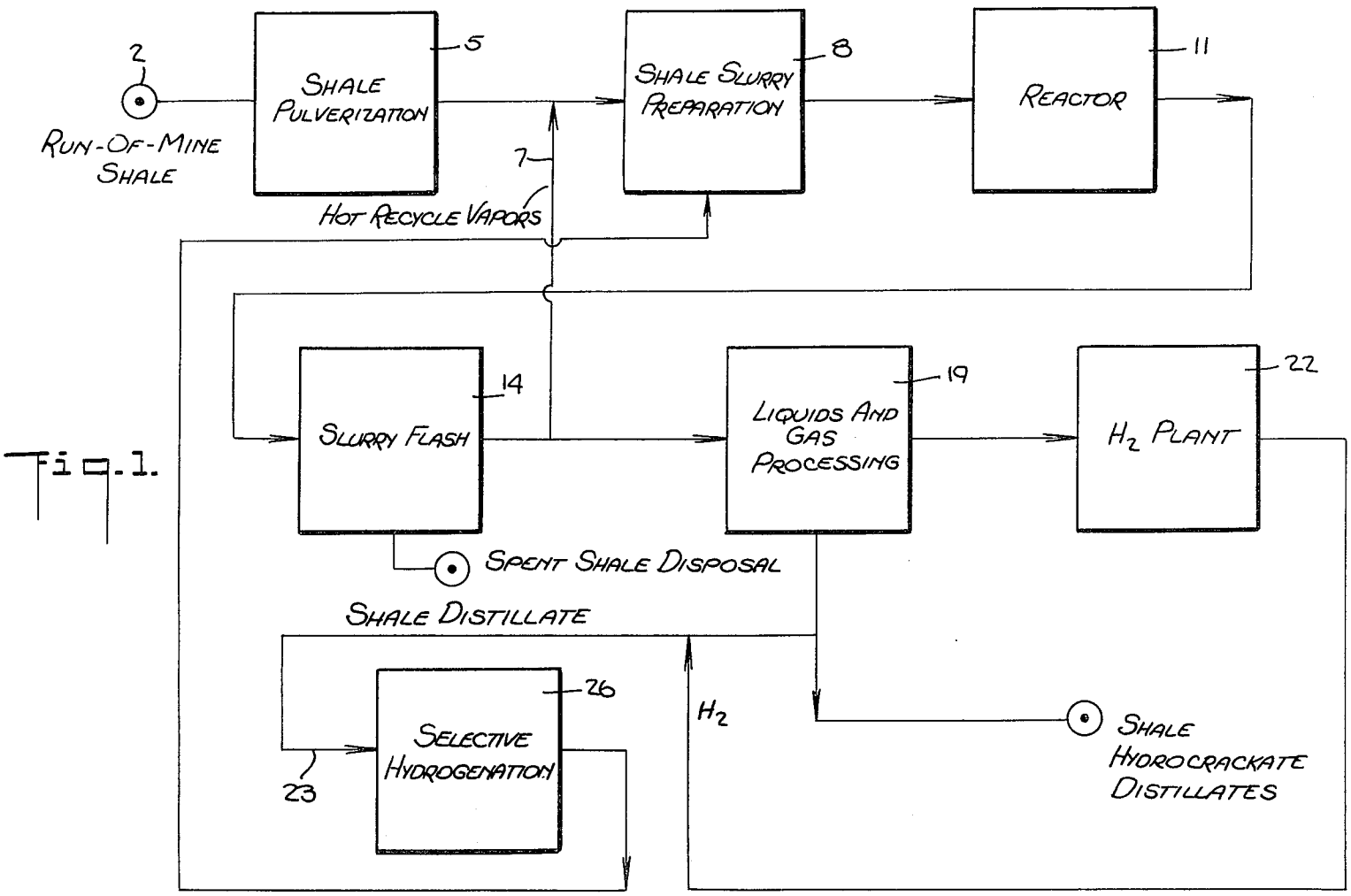

This invention relates to a method for the separation and recovery of organic material from rock, including the steps of forming a slurry containing the rock bearing the organic material and hydrogenating said material via a hydrogen transfer agent which is a liquid at standard conditions.

Previously known technologies relating to the recovery of organic material from rock, such as kerogen from oil shale, rely principally upon either thermal means or the use of molecular hydrogen and treat the rock in a substantially dry state, i.e., in the absence of any significant amount of liquid. See, for example, DT-OS No. 2,806,806 to Kraftwerk Union AG and *The IGT Hytort Process for Hydrogen Retorting of Devonian Oil Shales* by S. A. Weil et al., a paper dated Nov. 14, 1978 and presented at The Chattanooga Shale Conference. Such processes require the system transport of essentially dry rock and/or require the extensive use of inherently dangerous hydrogen gas.

Among the objects of the present invention are to provide a process for the hydrogenation and extraction of organics obtained in rock which permits the easy transport of organic-bearing rock through process equipment, avoids, with respect to the hydrogenation-/extraction step, the extensive use of molecular hydrogen or optionally the use of any molecular hydrogen, and permits the physical extraction of organics into a liquid phase. Further objects of the invention are to utilize the sensible heat of spent rock resulting from the process and the latent heat of flashed vapors generated during the process. A still further object of the invention is to provide a separation process that permits the handling and treatment of finely divided rock particles.

According to the invention, rock containing organic material is contacted with a hydrogen transfer agent that is liquid at standard conditions by forming a slurry of the rock to be treated and a liquid comprising such a hydrogen transfer agent.

In a preferred embodiment of the invention rock containing the organic material to be separated, such as oil shale, is pulverized, preheated via contacting with hot recycle vapors and slurried with a liquid comprising a hydrogen transfer agent. The slurry is reacted at elevated temperature and pressure and the product of the reaction flashed.

Preferred applications of the process of the invention include the separation and hydrogenation of kerogen in oil shale. Although it is known that molecular hydrogen will react with kerogen in shale to enhance the yield of shale oil and hydrocarbon gases obtained by retorting, the resultant reactions are comparatively nonselective, in that a wide range of hydrocarbon products from methane to higher molecular weight oils are formed. When hydrogenation agents according to the present invention are employed in the described manner, however, selective extraction and hydrogenation of kerogen occur, such that high yields of liquid hydrocarbons boiling between about 40° C. and 500° C., especially between 40° C. and 250° C., are obtained and yields of methane and other light hydrocarbon gases, which contain significantly more hydrogen per unit of carbon than the higher boiling hydrocarbons, are markedly reduced.

FIG. 1 is a block flow diagram of a preferred embodiment of the invention.

Suitable starting materials for use in the process of the invention include run-of-mine oil shales, comprising sedimentary rock and appreciable quantities of organic materials, such as the Devonian marine shales of the eastern United States and the Eocene lacustrine shales of the western United States. The invention is also useful for sand grains containing water and bitumen.

Suitable hydrogen transfer agents include distillates boiling in the range of from about 175° C. to about 325° C. and containing at least about 25 percent, preferably at least about 35 percent, hydrogen donating compounds, including hydroaromatics and multiphenols such as tetralin, alkylhydronaphthalenes, dihydronaphthalene, methyltetralin, alkylhydrophenanthrenes, naphthahydroquinone and the like.

According to a preferred embodiment illustrated in the block flow diagram of FIG. 1, run-of-mine oil shale 2 is first pulverized 5, in or without the presence of hydrogen transfer agent, and then contacted with hot recycle oil vapors 7 which are condensed on the pulverized shale. The pulverized shale, preheated by the latent heat yielded by the condensing oil vapors, is then incorporated into a slurry 8 comprising the condensed vapor and additional liquid comprising one or more suitable hydrogen transfer agents to form a slurry containing at least about 10 percent but no more than about 80 percent solids, with from about 40 to about 65 percent solids being preferred. The amount of hydrogen transfer agent in the slurry liquid is preferably greater than about 20 percent but may comprise as much as 90 percent of the liquid component of the slurry.

It is preferred, although not necessary, that all or substantially all of the liquid component of the shale slurry consist of hydrogen transfer agent(s). A preferred hydrogen transfer agent is a relatively low boiling petroleum distillate having, for example, a boiling point at atmospheric pressure in the range of from about 175° to about 325° C. A preferred source of such agent for use in the formation of the slurry of the instant invention is via the distillation and recovery of the low boiling range fraction from the flash chamber product. Most preferably, the distillate fraction of the flash chamber product boiling in the range of from about 175° to about 325° C. is separated out and is then hydrogen enriched either by selective hydrogenation over conventional hydrogenation catalysts, for example nickel-molybdenum-alumina, cobalt-molybdenum-alumina and the like, with the addition of some molecular hydrogen or by selective hydroisomerization over any suitable soild catalyst such as silica-alumina, silica-magnesia, silica-alumina-zirconia, acidic crystalline zeolites, noble metal reforming catalysts or the like, with the addition of some molecular hydrogen. Optionally, the hydrogen transfer agent may comprise a 175°-325° C. boiling range distillate derived from an externally supplied petroleum product such as a rerun fraction of a heavy naphtha reformate or a catalytically cracked aromatic cycle oil and may be used in the manner described for the shale distillate 23.

The slurry is then subjected to elevated temperature and pressure, preferably a pressure of from about 10 to about 200 atmospheres, most preferably from about 30 to about 70 atmospheres, and preferably a temperature of from about 300° to about 650° C., most preferably from about 400° to about 550° C., in reactor 11. Although the optimum residence time of the slurry in the reactor will vary with the specific rock/organic material under treatment, we prefer residence times varying from about 5 minutes to about 3 hours, with from about 10 minutes to about 2 hours being most preferred.

Following reactor dwell, the heated, pressurized slurry is sent to a flash chamber 14 operating at a pressure of from about 0.25 to about 8 atmospheres, preferably from at least about 1 to about 5 atmospheres, for the adiabatic flash vaporization of the organic materials and the resultant cooling of the residual hot solid rock particles. A stripping gas such as steam or light hydrocarbon(s) may optionally be employed in flash chamber 14. A portion of the vaporized material is recycled as hot recycle oil vapors 7 for preheating of the feed material and the remainder is sent for liquid and gas processing 19, while the cooled residual rock is sent to disposal. Optionally, a distillate 23 boiling in the range 175°–325° C. may be separated, hydrogen enriched, as shown at 26, and utilized in the slurry preparation 8. Also, molecular hydrogen may be recovered as shown at 22 and added to said distillate.

As indicated by the examples below, the process of the invention permits percent recoveries of Fischer Assay of fresh oil shale ranging from about 100 percent for western United States shale to about 300 percent for eastern United States shale. The feedstock for Examples 1, 2 and 3 of Table I is Colorado Medium Grade oil shale (western United States shale) having a Fischer Assay of 27 gallons per ton and for Examples 4, 5 and 6 of Table II is Kentucky Sunbury oil shale (eastern United States shale) having a Fischer Assay of 10 gallons per ton.

TABLE I

| Example No. | 1 | 2 | 3 |
|---|---|---|---|
| Slurry Content, % Solids | 45 | 50 | 55 |
| Slurry Vehicle | Tetralin | Tetralin/ Methyl-naphthalene | Tetralin/ Alkyl-naphthalene |
| Average Temp., °C. | 440 | 425 | 415 |
| Pressure, psig | 900 | 700 | 600 |
| Contact Time, min. | 45 | 60 | 75 |
| Conversions & Yields | | | |
| Gas Yield, Wt % | 2.0* | 1.8* | 1.4* |
| % Yield of Fischer Assay | 100 | 95 | 94 |

*Gas composition (S, $NH_3$ free basis): 35 vol % $H_2$, 35% $CO_2$, 15% $CH_4$, 10% $C_2H_6$, 5% $C_3H_8$

TABLE II

| Example No. | 4 | 5 | 6 |
|---|---|---|---|
| Slurry Content, % Solids | 50 | 55 | 65 |
| Slurry Vehicle | Tetralin | Tetralin/ Shale-Derived Oil | Tetralin/ Shale Derived Oil |
| Average Temp., °C. | 425 | 435 | 450 |
| Pressure, psig | 450 | 700 | 900 |
| Contact Time, min. | 60 | 40 | 20 |
| Conversions & Yields | | | |
| Gas Yield, Wt % | 0.7* | 0.8* | 0.5* |
| % Yield of Fischer Assay | 210 | 250 | 275 |

*50 vol % $H_2$, 20% $CH_4$, 15% $C_2H_6$, 15% $C_3H_8$

We claim:

1. In a method for the separation and recovery of organic material from rock, the improvement comprising the steps of:

(a) forming a slurry comprising rock containing organic material and a hydrogen transfer agent that is liquid at standard conditions;

(b) subjecting said slurry to elevated temperature and pressure; and (c) subjecting the product of step (b) to adiabatic flash vaporization.

2. A method according to claim 1, wherein said rock containing organic material is selected from the group consisting of oil shale and sand grains comprising bitumen.

3. A method according to claim 1, wherein said hydrogen transfer agent comprises at least one member of the group consisting of hydroaromatics, multiphenols, and a distillate boiling in the range of from about 175° to about 325° C.

4. A method according to claim 3, wherein said hydrogen transfer agent comprises at least one member of the group consisting of tetralin, alkylhydronaphthalenes, dihydronaphthalene, methyltetralin, alkylhydrophenanthrenes, and naphthahydroquinone.

5. A method according to claim 1, wherein said elevated temperature is from about 300° to about 650° C. and said pressure is from about 10 to about 200 atmospheres.

6. A method according to claim 1, wherein said hydrogen transfer agent comprises 175°–325° C. boiling range fraction of distillate obtained from the vaporized product of step (c).

7. A method according to claim 6, wherein said distillate is hydrogen enriched prior to its use in step (a).

8. A method according to claim 7, wherein said hydrogen enrichment comprises the selective hydrogenation of said distillate over conventional hydrogenation catalysts.

9. A method according to claim 8, wherein said hydrogen enrichment further comprises the addition of molecular hydrogen to said distillate.

10. A method according to claim 7, wherein said hydrogen enrichment comprises the selective hydroisomerization of said distillate over a solid catalyst.

11. A method according to claim 10, wherein said solid catalyst comprises at least one member of the group consisting of silica-alumina, silica-magnesia, silica-alumina-zirconia, acidic crystalline zeolites and noble metal reforming catalysts.

12. A method according to claim 1 including the additional step (d) of containing said rock with a portion of the vapor product of step (c) prior to step (b).

13. A method according to claim 12, wherein said contacting is accomplished prior to step (a).

14. A method for the hydrogenation and extraction of kerogen from oil shale, said method comprising the steps:

(a) pulverizing run-of-mine oil shale;

(b) slurrying pulverized shale with a liquid comprising a hydrogen transfer agent that is liquid at standard condition;

(c) subjecting said slurry to a temperature of from about 300° to about 650° C. and a pressure of from about 10 to about 200 atmospheres;

(d) adiabatically flash vaporizing the product of step (c);

(e) recycling a portion of the vapor product of step (d) to said shale prior to step (c);

(f) recovering from the product of step (d) a distillate boiling in the range of from about 175° to about 325° C.;

(g) subjecting distillate from step (f) to hydrogen enrichment; and (h) recycling hydrogen-enriched distillate from step (g) for use as hydrogen transfer agent in step (b).

15. A method according to claim 14, wherein the recycle of step (e) is introduced to said shale prior to step (b).

16. A method according to claim 14, wherein the temperature of step (c) is from about 400° to about 550° C.

17. A method according to claims 14 or 16, wherein said pressure is from about 30 to about 70 atmospheres.

18. A method according to claim 14, wherein said slurry comprises from about 40 to about 65 percent solids.

19. A method according to claim 14, wherein step (c) occurs over a period of from about 5 minutes to about 3 hours.

20. A method according to claim 19, wherein said period is from about 10 minutes to about 2 hours.

21. A method according to claim 14, wherein step (d) is conducted at a pressure of from about 0.25 to about 8 atmospheres.

22. A method according to claim 21, wherein said pressure is from about 1 to about 5 atmospheres.

23. A method according to claim 14 including the additional step (i) of utilizing a stripping gas during step (d).

24. A method for the hydrogenation and extraction of kerogen from oil shale, said method comprising the steps:

(a) pulverizing run-of-mine oil shale;

(b) preheating said shale;

(c) slurrying said shale with a liquid comprising a hydrogen transfer agent, said agent comprising a hydrogen-enriched distillate boiling in the range of from about 175° to about 325° C.;

(d) subjecting said slurry to a temperature of from about 400° to about 500° C. and a pressure of from about 30 to about 70 atmospheres for a period of from about 10 minutes to about 2 hours;

(e) adiabatically flash vaporizing the product of step (d) at a pressure of from about 1 to about 5 atmospheres;

(f) recycling a portion of the vapor product of step (e) for use in said preheating;

(g) separating from the product of step (e) a distillate boiling in the range of from about 175° to about 325° C.

(h) enriching the hydrogen content of said distillate; and (i) utilizing said hydrogen-enriched distillate as hydrogen transfer agent in step (c).

25. A method according to claim 24, wherein the recycled vapor product of step (f) is condensed on said shale prior to step (c) to effect said preheating.

26. A method according to claim 25, wherein the hydrogen enrichment of step (h) comprises the selective hydroisomerization of said distillate over a solid catalyst.

27. A method according to claim 26, wherein said catalyst comprises at least one member of the group consisting of silica-alumina, silica-magnesia, silica-alumina-zirconia, acidic crystalline zeolites and noble metal reforming catalysts.

28. A method according to claim 25, wherein the hydrogen enrichment of step (h) comprises the selective hydrogenation of said distillate over conventional hydrogenation catalysts.

29. A method according to claim 28, wherein said hydrogen enrichment further comprises the addition of molecular hydrogen to said distillate.

* * * * *